US010174476B2

(12) United States Patent
Luong

(10) Patent No.: US 10,174,476 B2
(45) Date of Patent: Jan. 8, 2019

(54) GRAB BUCKET OF AN AUGER

(71) Applicant: CONG TY TNHH PHU CUONG

(72) Inventor: Phu Cuong Luong, Tinh Binh Duong (VN)

(73) Assignee: CONG TY TNHH PHY CUONG, Tinh Binh Duong (VN)

( * ) Notice: Subject to any disclaimer, the term of this patent is extended or adjusted under 35 U.S.C. 154(b) by 133 days.

(21) Appl. No.: 14/582,627

(22) Filed: Dec. 24, 2014

(65) Prior Publication Data

US 2015/0259872 A1 Sep. 17, 2015

(30) Foreign Application Priority Data

Mar. 17, 2014 (VN) ..... 2-2014-00057

(51) Int. Cl.

| | |
|---|---|
| ***E02D 17/13*** | (2006.01) |
| ***E02F 3/413*** | (2006.01) |
| ***E02F 3/47*** | (2006.01) |
| ***E02F 5/16*** | (2006.01) |

(52) U.S. Cl.

CPC ..... *E02D 17/13* (2013.01); *E02F 3/413* (2013.01); *E02F 3/475* (2013.01); *E02F 5/16* (2013.01)

(58) Field of Classification Search

CPC ... E02F 3/47; E02F 3/475; E02F 3/413; E02F 5/16; E02D 17/13; E21B 7/006; E21B 27/00; E21B 27/04

See application file for complete search history.

(56) References Cited

U.S. PATENT DOCUMENTS

| | | | | | |
|---|---|---|---|---|---|
| 287,139 | A * | 10/1883 | Little | B66C 3/02 | 37/182 |
| 388,109 | A * | 8/1888 | Beckers | B66C 3/02 | 37/182 |
| 692,417 | A * | 2/1902 | Beckers | B66C 3/02 | 37/182 |
| 745,448 | A * | 12/1903 | Marrder | B66C 3/02 | 37/182 |
| 827,635 | A * | 7/1906 | Hone | B66C 3/16 | 37/187 |
| 1,481,336 | A * | 1/1924 | Armstrong | B66C 3/16 | 37/182 |
| 1,544,969 | A * | 7/1925 | Cooper | B66C 3/06 | 37/187 |
| 2,867,047 | A * | 1/1959 | Zimmermann | B66C 3/02 | 37/182 |
| 3,194,329 | A * | 7/1965 | Wallers | E02F 3/47 | 175/101 |
| 3,303,590 | A * | 2/1967 | Grospas | B66C 3/12 | 37/187 |

(Continued)

*Primary Examiner* — Jessica H Lutz
(74) *Attorney, Agent, or Firm* — Abelman, Frayne & Schwab

(57) ABSTRACT

A grab bucket for making reinforced concrete piles of high load bearing capacity. The grab bucket includes a framework with three wings, a moving assembly movable upward and downward along the length of the framework, a fixed assembly mounted beneath the moving assembly, three grab buckets mounted pivotally to the fixed assembly and having boring teeth oriented outwards, three pushing frames for closing the three grab buckets, and a transmission configured to control opening and closing of said bucket sections in unison.

2 Claims, 7 Drawing Sheets

(56) References Cited

U.S. PATENT DOCUMENTS

| | | | | | |
|---|---|---|---|---|---|
| 3,479,077 | A * | 11/1969 | Spears | B66C 3/16 | 212/243 |
| 3,949,498 | A * | 4/1976 | Iwata | B66C 3/02 | 294/68.23 |
| 5,330,242 | A * | 7/1994 | Lucky, Sr. | B66C 3/16 | 294/106 |
| 5,707,182 | A * | 1/1998 | Leffer | E02D 17/13 | 37/348 |
| 6,076,290 | A * | 6/2000 | Seitle | E02F 3/475 | 37/348 |
| 2004/0168831 | A1* | 9/2004 | Nozaki | E02F 3/47 | 175/267 |
| 2005/0000124 | A1* | 1/2005 | Rohr | B66C 3/16 | 37/398 |
| 2008/0066350 | A1* | 3/2008 | Humphries | E02D 17/13 | 37/348 |
| 2008/0179069 | A1* | 7/2008 | Loeffelholz | E02D 17/13 | 172/35 |
| 2015/0128458 | A1* | 5/2015 | Trevisani | E02D 17/13 | 37/184 |

* cited by examiner

GRAB BUCKET OF AN AUGER

CROSS-REFERENCE TO RELATED APPLICATIONS

This application is related to and claims priority to Vietnam Patent Application No. 2-2014-00057, filed Mar. 17, 2014, the disclosure of which is incorporated herein by reference and made a part of this application.

FIELD OF THE INVENTION

The invention is related to grab buckets of augers, particularly grab buckets, which can be in use for digging three-pointed holes, thereby making reinforced concrete piles that have corresponding Y-shape or three-pointed cross-sections and high strengths.

BACKGROUND OF THE INVENTION

In recent decades, reinforced concrete piles have been widely used in the world in general and in Vietnam in particular for building up heavy duty works, those include jack piles, cast-in-situ piles, Barrettes piles, concrete driven piles.

Jack piles have low construction costs but jacking (driving) is causative of shaking to adjacent works. The strength of jack piles is limited. Particularly, long piles are made by means of many joints, which are easy to be ruined and consequently reducing the load-bearing capacity of piles. Further, the use of this kind of piles badly affects the boring for basement construction, during which pile heads are easy to be tilted and broken.

Cast-in-situ piles and Barrettes piles have higher strengths and fewer impacts on adjacent works. Nevertheless, the costs for making these piles are high. Furthermore, quality control during construction is complicated, particularly control of verticality of the bored holes.

In general, all the piles mentioned above have those backwards because of their simple shapes with circular or rectangular cross-sections. It is therefore necessary to make reinforced concrete piles with more complicated shapes in order to obviate the backwards. Nevertheless, that is currently required a process of many steps, more time and higher expenses. In practice, many piles have been made failing to meet technical requirements. For instance, a pile with T-shape cross-section needs to be made in two steps, each step for one point of the cross-section. For any pile with a cross-section, which includes some parts not perpendicular, for instance, piles with a three-pointed or Y-shape cross-section, it is much more difficult since it is not easy to bore a hole meeting requirements, or walls of the bored hole are not vertical, and eventually, the resultant piles fail to meet technical specifications.

It is, therefore, an object of the invention to provide a grab bucket that helps to make reinforced concrete piles of high strength.

Another object of the invention is to provide a grab bucket that helps to make reinforced concrete piles with less material.

Another object of the invention is to provide a grab bucket that help to reduce costs of human and time for making reinforced concrete piles.

A further object of the invention is to provide a grab bucket to make reinforced concrete piles of consistent quality.

SUMMARY OF THE INVENTION

The grab bucket of the auger according to the present invention is characterized mainly in that it includes three bucket sections which are arranged in angles to each others, and which can be opened or closed in unison. More preferably, the three bucket sections are arranged symmetrically.

BRIEF DESCRIPTION OF THE DRAWINGS

These objects and other objects of the invention will appear more clearly from the following specification in connection with the accompanying drawings, in which.

DETAILED DESCRIPTION

Figure 1:
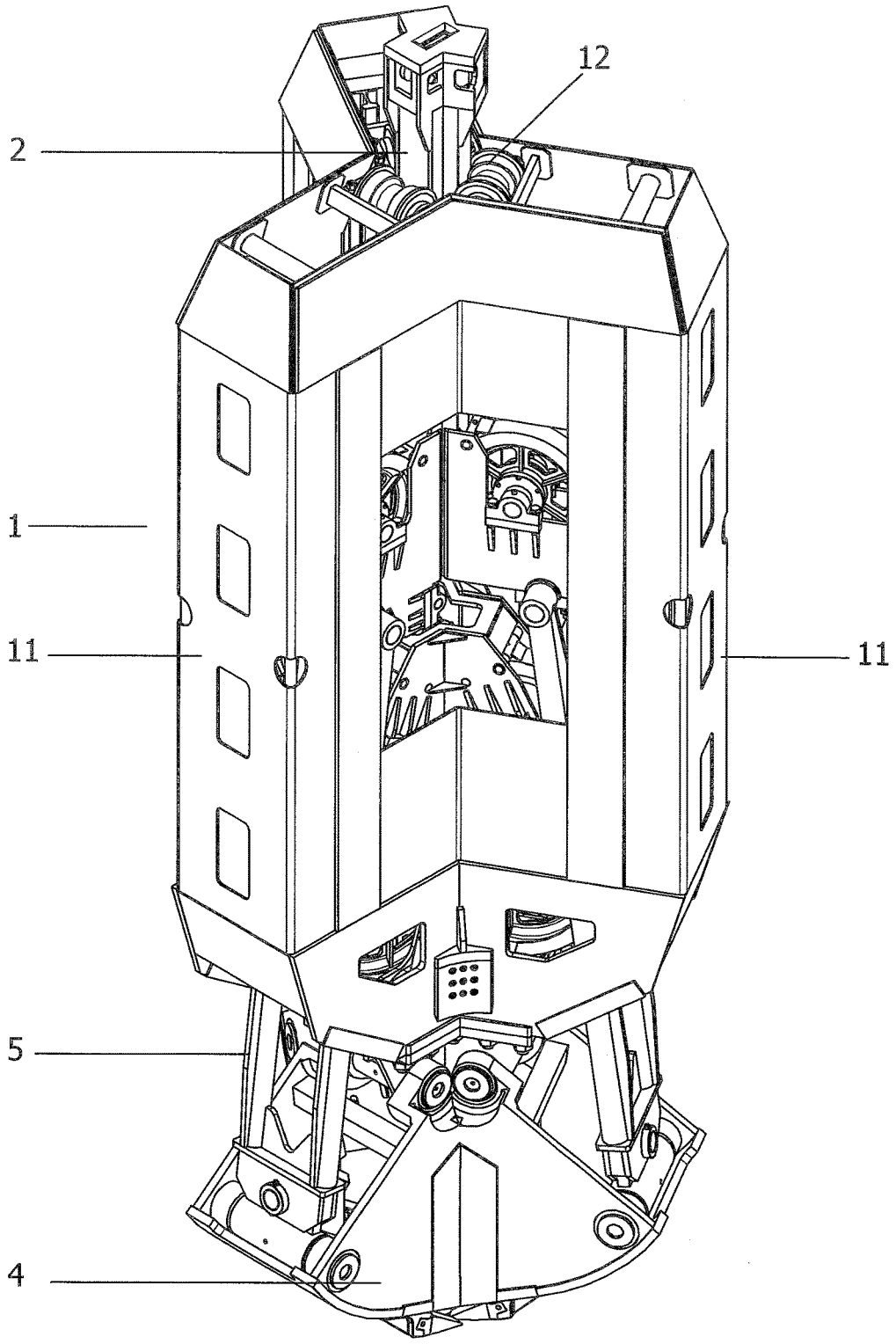
FIG. 1 is a perspective view of a grab bucket of an embodiment of the invention.
Figure 2:
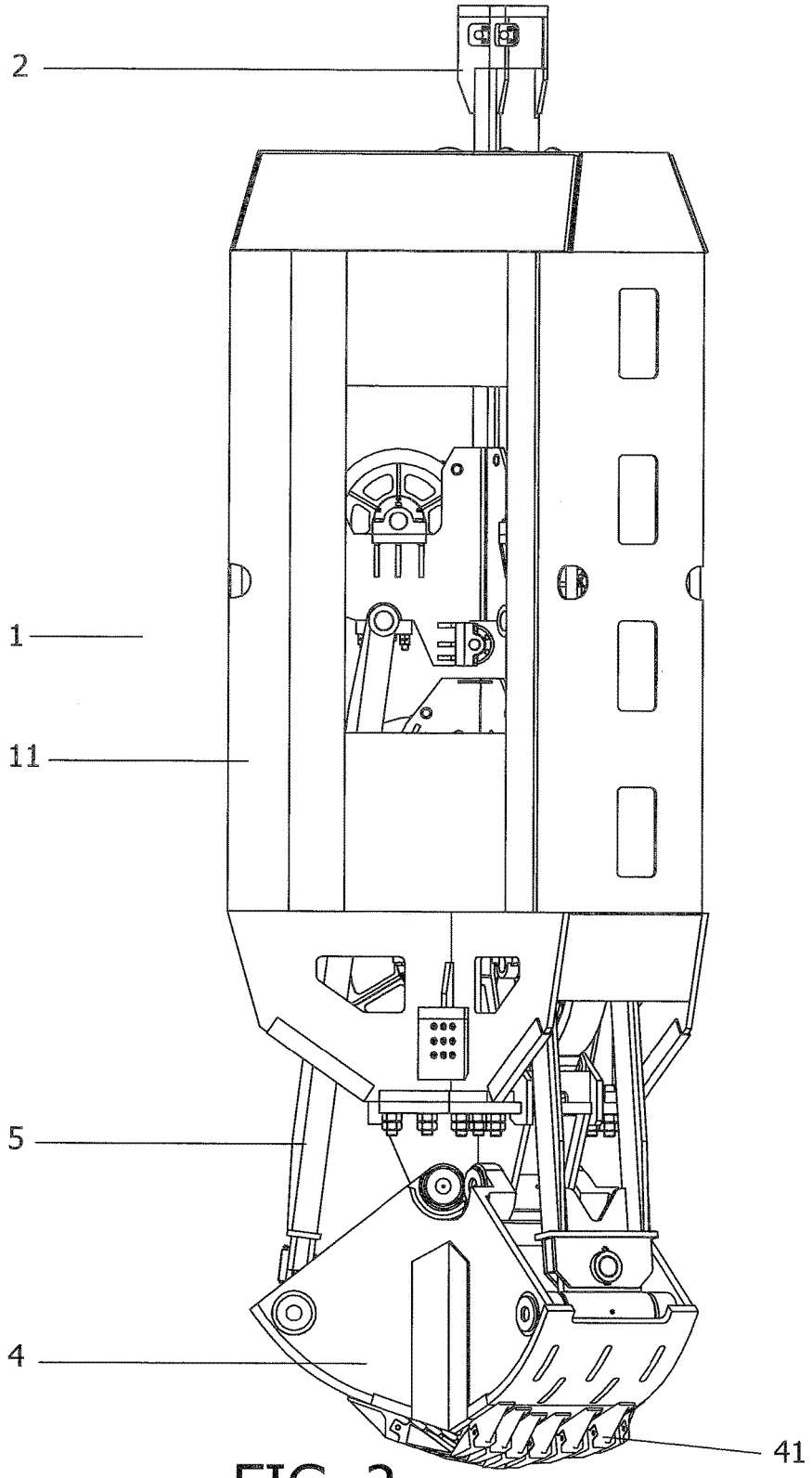
FIG. 2 is a front view of a grab bucket of an embodiment of the invention.
Figure 3:
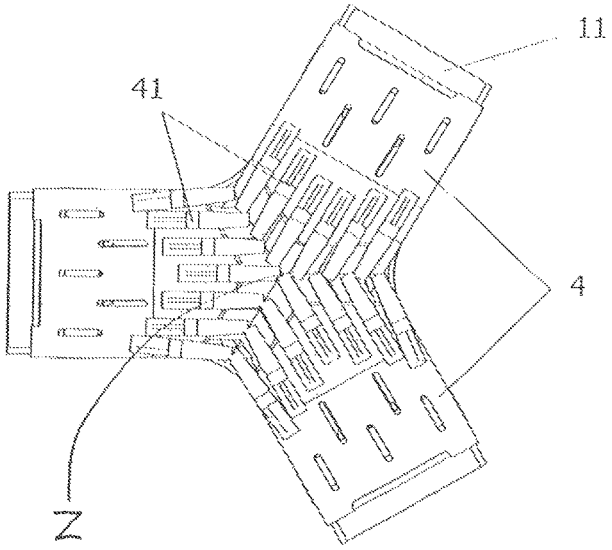
FIG. 3 is a bottom view of a grab bucket of an embodiment of the invention.
Figure 4:
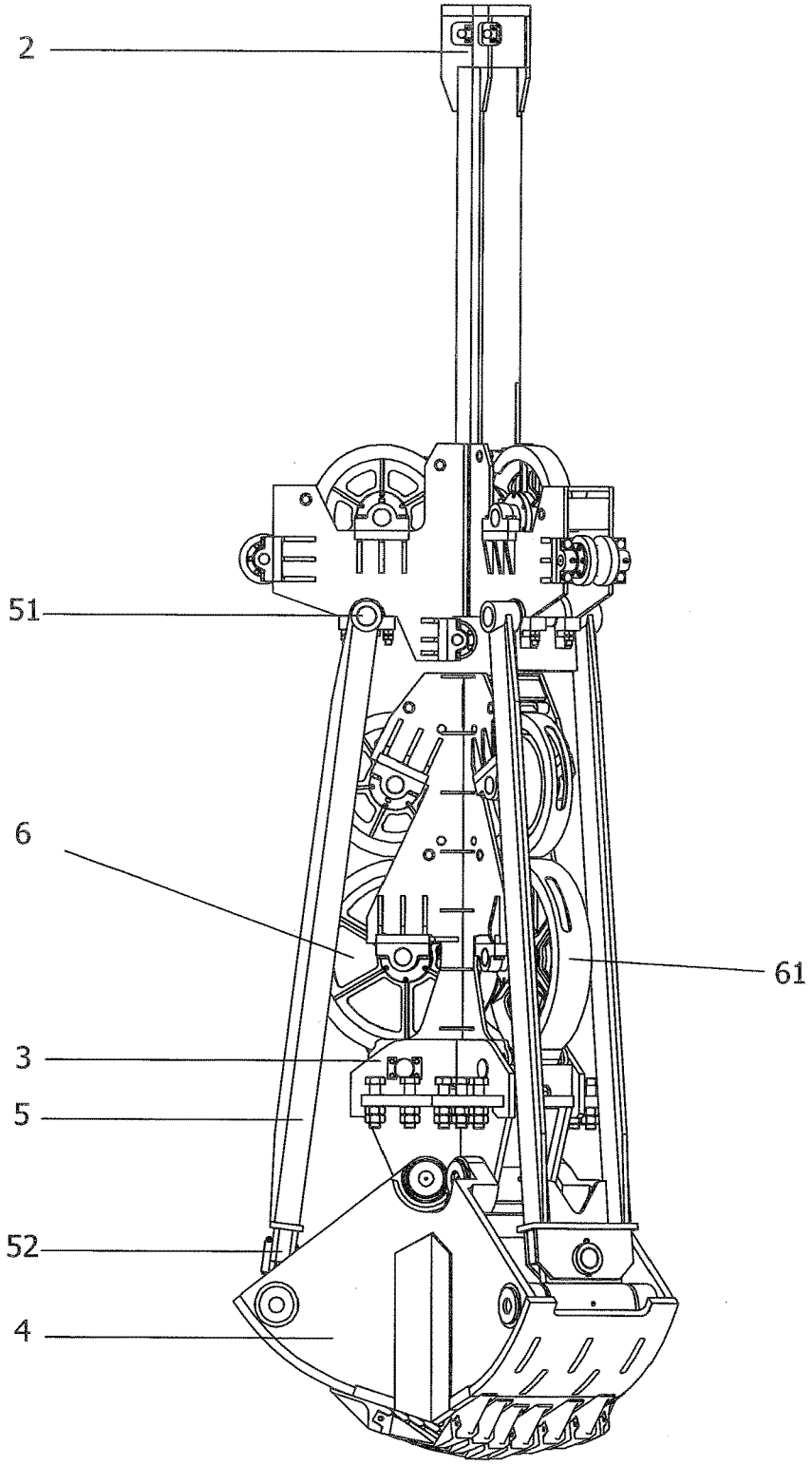
FIG. 4 is a perspective view of a grab bucket of an embodiment of the invention with the framework removed in order to show the inner structure thereof in closing condition.
Figure 5:
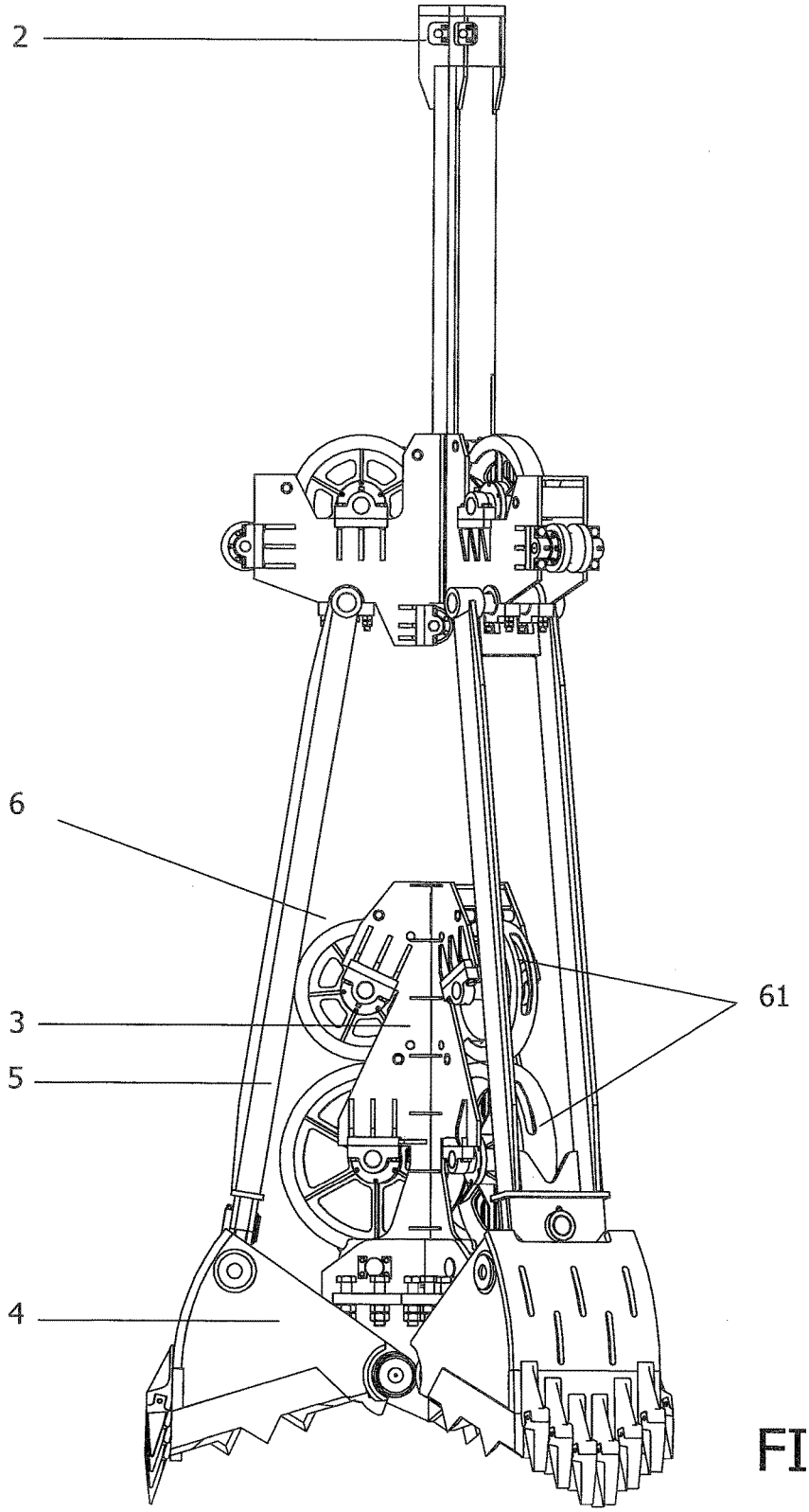
FIG. 5 is a perspective view of a grab bucket of an embodiment of the invention with the framework removed in order to show the inner structure thereof in opening condition.

It is well known that a grab buckets should be used together with a common base (for instance, a crawler crane) (not shown in drawings) for making piles of rectangular cross-sections.

Referring now to FIGS. 1 to 6, in a preferred embodiment of the invention, a grab bucket is consisting of a framework 1, a moving assembly 2, a fixed assembly 3, three grab buckets 4, three pushing frames 5 and a transmission 6. As seen in the bottom plan view in FIG. 3 and in FIG. 7, the 3 grab buckets are arranged to be 120° apart about a central longitudinal axis Z.

The framework 1 is made of a hard alloy with three wings 11 corresponding to the shape of the hole to be dug. The framework 1 includes three guide rollers 12 mounted on its upper end. During operation of the auger, the framework 1 moves along the depth of the bored holes.

The moving assembly 2 can move upright relative to the framework 1. In a preferred embodiment of the invention, the moving assembly 2 contacts and rolls on three guide rollers 12, thereby the vertical movement of the moving assembly 2 is ensured without deviation. The moving assembly 2 is hanged to a hanging cable of the base (crawler crane).

The fixed assembly 3 is fixed to the frame 1 beneath the moving assembly. Three bucket sections 4 are mounted in the fixed assembly and arranged corresponding to the three-pointed shape 11 of the framework 1 and beneath the framework 1. Each bucket section 4 is mounted pivotally to the fixed assembly 3 with auger teeth 41 oriented outwards. In general, three bucket sections 4 are designed such that when all three bucket sections 4 are closed, they embraced tightly in order to contain the spoil therein.

Three pushing frame 5 are mounted between the moving assembly 2 and bucket sections 4. Each pushing frame 5 has a first end 51 fixed to the moving assembly 2 and a second end 52 mounted to the bucket sections 4 such that when the moving assembly 2 move downwards or upwards, the bucket sections 4 are closed or opened correspondingly. In conformity with the purposes of closing and opening bucket sections 4, the pushing frame 5 is designed so as to be slightly tilted outwards from top to bottom; the tilt angle can be easily calculated based on the dimension and shape of the bucket sections 4.

Figure 6:
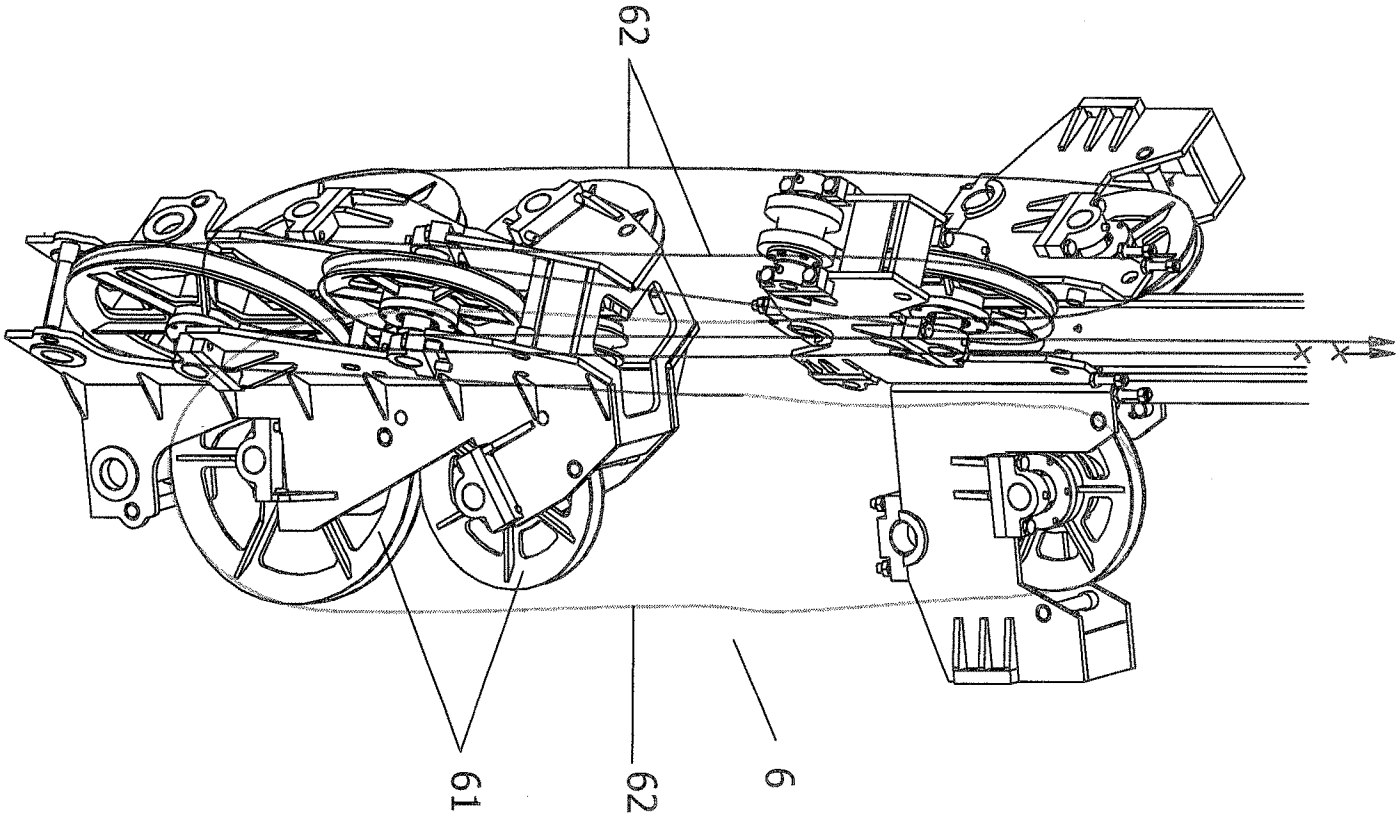
FIG. 6 is a perspective view of a grab bucket of an embodiment of the invention with the framework removed in order to show the inner structure of the grab bucket operated with cables.
Figure 7:
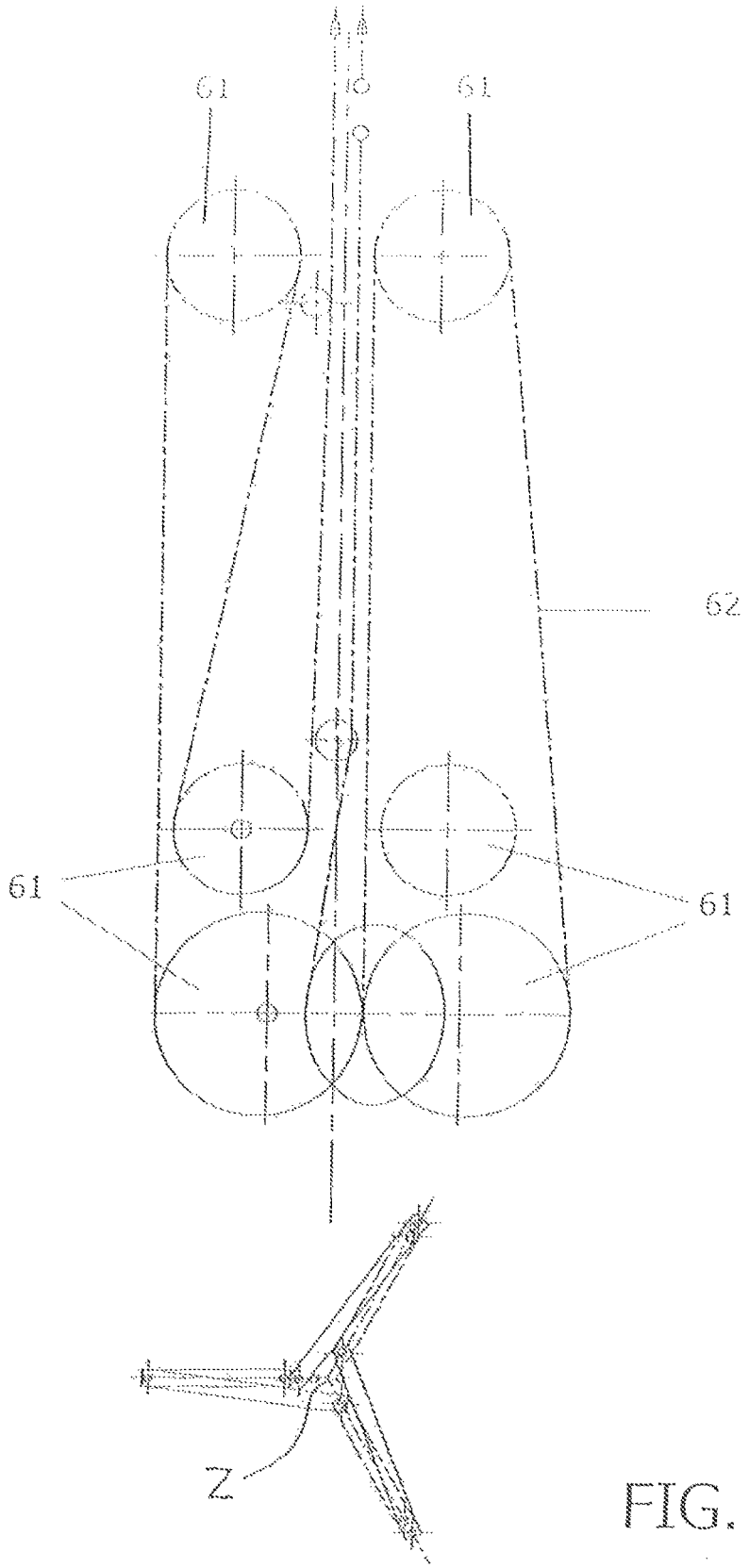
FIG. 7 is a diagrammatic view illustrating the transmission principle of the grab bucket in an embodiment of the invention.

The transmission 6 is arranged amid the moving assembly 2 and the fixed assembly 3 so as to close or open bucket sections 4 in unison. There are various ways to design the transmission 6 for closing and opening three grab buckets in unison, for instance, cableway transmission or hydraulic transmission. In case of cableway transmission, as illustrated in FIGS. 6 and 7, it is possible to install pulleys 61 to the framework 1 and cable 62 through those pulleys 61 for controlling the opening and closing of bucket sections 4.

As such, with three grab buckets 4 arranged angled from one another, it is possible to make piles with three-pointed cross-sections of various dimensions in a quick and easy manner without a plurality of steps as in the past. Arrangements of three grab buckets 4 make it possible to design various shapes for making reinforced concrete piles.

In a preferred embodiment, three wings 11 of the framework 1 are symmetrical; accordingly three grab buckets 4 are angled evenly. That makes it easy to fabricate grab buckets thanks to its symmetrical nature, since bucket sections have the same dimension and shape.

The grab bucket of the present invention works as follows: At first, the whole grab bucket is hanged on a hanging cable (one cable end is connected to the moving assembly 2, another cable end is wound on a winch lift of the base (crawler crane)) then slowly dropped to the bored hole, and the three grab buckets 4 are opened maximum, and thanks to its large weight, grabbing teeth 41 are thrust deeply to the ground, then the moving assembly 2 moves down towards the fixed assembly 3. By means of the pulling force of the driving cable (for the grab bucket operated by mechanical transmission) or the pushing force of cylinders (for the grab bucket operated by hydraulic transmission), via the pushing frame 5, bucket sections 4 are closed, and at the same time, the ground is cut by grabbing teeth 41 and moved into bucket sections 4. Then, the grab bucket is lifted up out of the bored hole by the hanging cable and moved to a dump site, where the grab bucket is opened to discharge of spoil. In order to open grab sections 4, the driving cable is released freely downwards and the weight of the entire grab bucket (except for the moving assembly 2) makes the moving assembly 2 to move far from the fixed assembly 3, that makes the pushing frame 5 open bucket sections 4 and release spoil freely. Eventually, the whole grab bucket is moved back to the bored hole for the next grabbing cycle.

The grab bucket of the auger in the present invention help to make bored holes of three-pointed cross-section, meaning that the volume of spoil (ground removed by the auger) and the corresponding materials for making reinforced concrete piles are significantly reduced, estimated at 40% to 47%.

As the contact surface area between the pile walls and the ground is larger, the friction force between them is stronger and the load bearing capacity of the pile is higher.

Thanks to decreases in materials volumes, work loads and increases in load bearing capacity of piles, the invention can bring in significant efficiency, which includes shorter time and much more economic when compared with conventional piles.

Thanks to three-pointed cross-sections, the piles made by the grab bucket of the present invention have much better torsional strengths and displacement resistance when compared with those of conventional piles.

The invention claimed is:

1. A grab bucket of an auger, comprising:

a framework having a length and a central vertical axis and shaped to form three wings situated at 120 degrees apart about said central vertical axis;

a moving assembly mounted so as to be movable upward and downward along the length of the framework;

a fixed assembly mounted beneath and to the moving assembly;

three grab bucket sections arranged 120 degrees apart in correspondence with said shape of the framework, each of said grab bucket sections being mounted pivotally to the fixed assembly and having boring teeth oriented downward when said bucket sections are open;

three pushing frames, each pushing frame having a first end pivotably coupled to the moving assembly, and an opposite end pivotably coupled to one of the grab bucket sections;

a transmission comprising a system of pulleys and cables, and coupling said fixed assembly with the moving assembly, said transmission configured for said pushing frames to close said bucket sections in unison when said moving assembly is moved downward, and to allow said bucket sections in unison to open by the force of their own weight when said fixing assembly moves downward, wherein each bucket section has a first pivot point coupled to said opposite end of one of said pushing frames, and a second pivot point coupled to said fixed assembly, and wherein cables of said system of pulleys and cables are configured to pull said second pivot points of said bucket sections upward with respect to said fixed assembly to thereby close said bucket sections, wherein said system of pulleys and cables comprises for each bucket section at least one upper pulley rotatably mounted to said moving assembly and at least one lower pulley rotatably mounted to said fixed assembly and a cable interconnecting said upper and lower pulleys.

2. A grab bucket of an auger, comprising:

a framework having a predetermined length and a central vertical axis and shaped to form three wings situated at 120 degrees apart about said central vertical axis;

a moving assembly mounted so as to be movable upward and downward along said predetermined length of said framework;

a fixed assembly mounted beneath and to said moving assembly;

three grab buckets sections arranged 120 degrees apart in correspondence with said shape of said framework, each of said grab bucket sections being mounted pivotally to said fixed assembly and having respective boring teeth oriented downward when said bucket sections are open;

three pushing frames, each having a first end pivotably coupled to said moving assembly and an opposite end pivotably coupled to one of said grab bucket sections;

a transmission comprising a system of pulleys and cables and coupling said fixed assembly with said moving assembly, said transmission configured to close said bucket sections in unison when said moving assembly is moved downward and to allow said bucket sections to open by the force of their own weight when said fixed assembly moves downward, wherein each bucket section has a first pivot point coupled to said opposite end of one of said pushing frames, and a second pivot point coupled to said fixed assembly, and wherein cables of said system of pulleys and cables configured to pull said second pivot points of said bucket sections upward with respect to said moving assemblies, thereby closing said bucket sections, wherein said system of pulleys and cables comprises for each bucket section at least one upper pulley rotatably mounted to said moving assembly and at least one lower pulley rotatably mounted to said fixed assembly and a cable interconnecting said upper and lower pulleys.

* * * * *